US006820852B2

(12) United States Patent
Wainscott et al.

(10) Patent No.: US 6,820,852 B2
(45) Date of Patent: Nov. 23, 2004

(54) PILLOW BOOK HOLDER AND METHOD THEREFOR

(76) Inventors: Joyce E. Wainscott, 4309 Roanridge Ave., Las Vegas, NV (US) 89120; Lorin S. Park, 158 Matterhorn, Mt. Charleston, NV (US) 89124

( * ) Notice: Subject to any disclaimer, the term of this patent is extended or adjusted under 35 U.S.C. 154(b) by 14 days.

(21) Appl. No.: 09/963,629

(22) Filed: Sep. 27, 2001

(65) Prior Publication Data

US 2003/0057344 A1 Mar. 27, 2003

(51) Int. Cl.[7] ..... A47B 5/00; A47C 20/02
(52) U.S. Cl. ..... 248/444.1; 5/636; 5/645
(58) Field of Search ..... 248/444.1, 445, 248/441.1; 5/636, 645, 643

(56) References Cited

U.S. PATENT DOCUMENTS 1,928,806 A * 10/1933 Barcalo ..... 248/441.1
3,809,352 A * 5/1974 Mathias ..... 248/451
4,309,784 A * 1/1982 Cohen ..... 5/442
4,768,245 A * 9/1988 Dutton ..... 5/434
4,993,680 A * 2/1991 Gemmen ..... 248/444
5,475,886 A * 12/1995 Mintz ..... 5/653
5,611,601 A * 3/1997 Cowgur ..... 297/393
5,652,983 A * 8/1997 Kraemer ..... 5/639
5,778,468 A * 7/1998 Saarela ..... 5/636
5,864,903 A * 2/1999 Newman ..... 5/639
5,898,962 A * 5/1999 McNeal ..... 5/639
D411,401 S * 6/1999 Edick ..... D6/601
6,061,854 A * 5/2000 Crowley ..... 5/655
6,270,050 B1 * 8/2001 Friedrich ..... 248/444
D448,960 S * 10/2001 Leverette ..... D6/596

OTHER PUBLICATIONS

Publishers Weekly, Aug. 6, 2001, pictures from web site http://www.readupon.com.*

* cited by examiner

*Primary Examiner*—Ramon O. Ramirez
*Assistant Examiner*—Amy J Sterling
(74) *Attorney, Agent, or Firm*—Craig Weiss; Harry M. Weiss; Weiss, Moy & Harris, P.C.

(57) ABSTRACT

A pillow book holder capable of allowing a reader to read a book without unnecessary hand muscle strain while at the same time the pillow book holder is capable of falling without damaging itself, the book, or losing the page place.

11 Claims, 1 Drawing Sheet

PILLOW BOOK HOLDER AND METHOD THEREFOR

FIELD OF THE INVENTION

This invention relates generally to book holders and, more specifically, to a pillow book holder having a transparent, plastic-type material coupled to a pillow, thus allowing a book to be inserted between the pillow and the transparent, plastic-type material.

BACKGROUND OF THE INVENTION

People who read books, especially those people who read books while lying in bed, often find it difficult to hold their book open in a position that is both comfortable for their hand as well as for their eyes. Book readers are frequently forced to change their hand position in order to release the hand muscles that have become uncomfortably tensed from maintaining a book in an open position. This constant changing of position is not only annoying, but can also cause eyesight related problems as the eye muscles strain to focus on the words of a page as it is being moved.

Various book holders have been devised to take pressure off of the hands, but they are generally not suitable for reading in bed. In the common event that the reader should fall asleep while reading in bed, prior art book holders are not designed to fall without damage to the book holder or the book. Even if no damage were to come to the book or book holder from a fall, the reader's page place in the book will very likely be lost.

A need therefore existed for a pillow book holder capable of allowing a reader to read a book without unnecessary hand muscle strain while at the same time the pillow book holder is capable of falling without damaging itself, the book, or losing the page place of the book.

SUMMARY OF THE INVENTION

An object of the present invention is to provide a pillow book holder capable of allowing a reader to read a book without the need to manually hold the pages open, thus limiting hand muscle strain.

It is a further object of the present invention to provide a pillow book holder capable of withstanding a fall without damage to the book holder, a book, or loss of page place.

BRIEF DESCRIPTION OF THE PREFERRED EMBODIMENTS

In accordance with one embodiment of the present invention, a pillow book holder is disclosed, comprising, in combination, a pillow having a front side and a back side, and a transparent plastic-type material coupled to a portion of the front side of the pillow and dimensioned to receive a book between the transparent plastic-type material and the front side of the In accordance with another embodiment or the present invention, a method for reading a book is disclosed, comprising, in combination, the steps of providing a pillow having a front side and a back side, providing a transparent plastic-type material coupled to a portion of the front side of the pillow and dimensioned to receive a book between the transparent plastic-type material and the front side of the pillow, inserting an open book between the front side of the pillow and the transparent plastic-type member, and reading the book.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
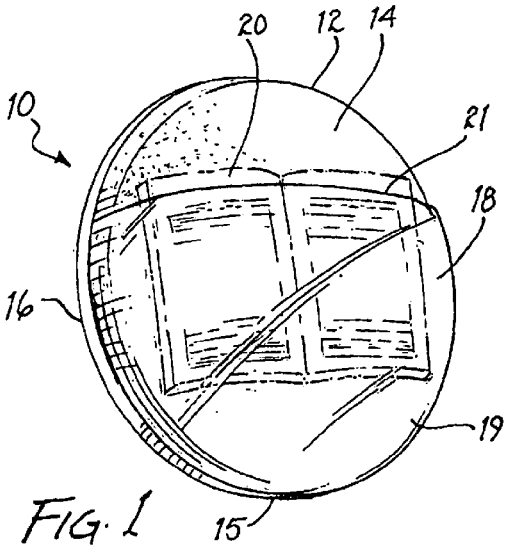
FIG. 1 is a perspective view of the preferred embodiment of the pillow book holder of the present invention, showing a book inserted between the pillow and the transparent, plastic-type material.

Referring to FIGS. 1–5 reference number 10 refers generally to the preferred embodiment of the pillow book holder of the present invention. The pillow book holder 10 comprises a pillow 12 having a front side 14 and a back side 16. A transparent, plastic-type material 18 is coupled to a portion of the front side 14 of the pillow 12 and dimensioned to receive a book 20 (shown in FIG. 1) between the transparent, plastic-type material 18 and the front side 14 of the pillow 12. Preferably, a closed end 19 (shown in FIGS. 1, 3 and 5) of the transparent, plastic-type material 18 is coupled to a bottom end 15 of the front side 14 of the pillow 12. Preferably, an open end 21 (shown in FIGS. 1, 3 and 5) of the transparent, plastic-type material 18 is coupled to an upper portion of the front side 14 of the pillow 12. It should be clearly understood, however, that substantial benefit could be derived from an alternative configuration of the pillow book holder 10 in which the closed end 19 and the open end 21 of the transparent, plastic-type material 18 are coupled to different areas of the front side 14 of the pillow 12, so long as a book 20 can be inserted between the transparent, plastic-type material 18 and the front side 14 of the pillow 12.

Preferably, the pillow book holder 10 is dimensioned to hold a book 20 in an open position so that two pages can be read through the transparent plastic-type material 18, however, it should be clearly understood that substantial benefit could be derived from an alternative configuration of the pillow book holder 10 in which only one page of a book 20 can be read through the transparent, plastic-type material 18. Additionally, it should be understood that substantial utility could also be derived from an alternative configuration of the pillow book holder 10 in which the plastic-type material 18 holds a book 20 in a closed position.

Figure 2:
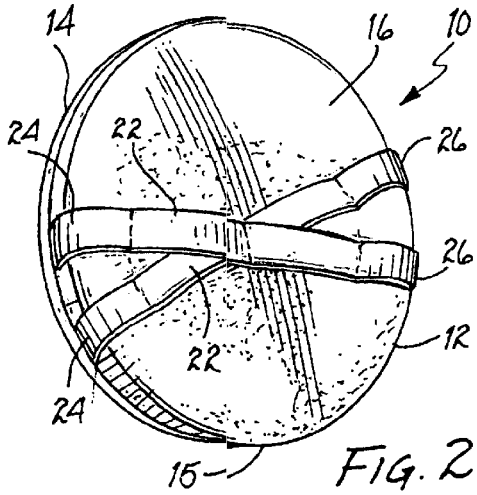
FIG. 2 is a back, perspective view of the pillow book holder of FIG. 1, showing two straps coupled to opposite ends of the back side of the pillow.
Figure 3:
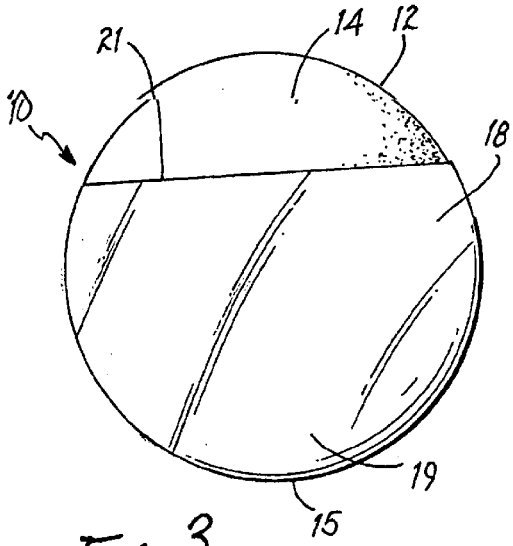
FIG. 3 is a front view of the pillow book holder of the present invention, without a book.
Figure 5:
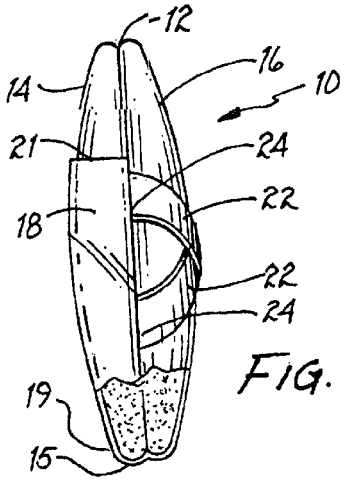
FIG. 5 is a side, partially cross-sectional view of the pillow book holder of FIG. 1.
Figure 4:
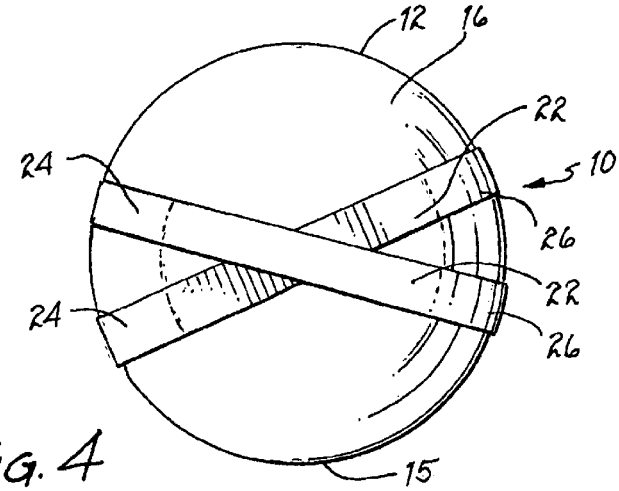
FIG. 4 is a back view of the pillow book holder of FIG. 1.

In the preferred embodiment, the pillow book holder 10 comprises at least one, and preferably two straps 22 (shown in FIGS. 2, 4 and 5). Each strap 22 has a first end 24 and a second end 26 with the first end 24 coupled to one side of the back side 16 of the pillow 12 and the second end 26 coupled to an opposite side of the back side 16 of the pillow 12. The straps 22 are designed to provide a reader with the ability to grip the pillow book holder 10 without hand muscle strain.

While the invention has been particularly shown and described with reference to preferred embodiments thereof, it will be understood by those skilled in the art that the foregoing and other changes in form and details may be made therein without departing from the spirit and scope of the invention.

We claim:

1. A pillow book holder, comprising, in combination:

a pillow having a front side and a back side; and a transparent plastic-type material coupled to a portion of said front side of said pillow and dimensioned to receive a book between said transparent plastic-type material and said front side of said pillow, said book having a back side in contact with said front side of said pillow.

2. The pillow book holder of claim 1 wherein said transparent plastic-type material is dimensioned to hold said book so that the two pages can be read through said transparent plastic-type material.

3. The pillow book holder of claim 1 further comprising at least one strap having a first end and a second end, said first end of said strap is coupled to one end of said back side of said pillow and said second end of said strap is coupled to an opposite end from said back side of said pillow.

4. The pillow book holder of claim 1 further comprising a first strap and a second strap each having a first end and a second end, said first end of said first strap is coupled to a first end of said back side of said pillow, said second end of said first strap is coupled to an opposite end from said first end of said back side of said pillow, said first end of said second strap is coupled to a second end of said back side of said pillow, said second end of said second strap is coupled to an opposite end from said second end of said back side of said pillow.

5. The pillow book holder of claim 1 wherein a closed end of said transparent plastic-type material is coupled to a bottom end of said front side of said pillow and an open end of said transparent plastic-type material is coupled to an upper portion of said front side of said pillow.

6. A method for reading a book comprising, in combination, the steps of:

providing a pillow having a front side and a back side;

providing a transparent plastic-type material coupled to a portion of said front side of said pillow and dimensioned to receive a book between said transparent plastic-type material and said front side of said pillow, said book having a back side in contact with said front side of said pillow;

inserting an open book between said front side of said pillow and said transparent plastic-type member; and reading said book.

7. The method of claim 6 wherein said transparent plastic-type material is dimensioned to hold the book in an open position so that the two pages can be read through said transparent plastic-type material.

8. The method of claim 6 further comprising the steps of:

providing at least one strap having a first end and a second end, said first end of said strap is coupled to one end of said back side of said pillow and said second end of said strap is coupled to an opposite end from said back side of said pillow;

inserting at least one hand under said at least one strap; and positioning said front side of said pillow at a distance sufficient to allow a reader to read from said book.

9. The method of claim 6 further comprising the steps of:

providing a first strap and a second strap each having a first end and a second end, said first end of said first strap is coupled to a first end of said back side of said pillow, said second end of said first strap is coupled to an opposite end from said first end of said back side or said pillow, said first end of said second strap is coupled to a second end of said back side of said pillow, said second end of said second strap is coupled to an opposite end from said second end of said back side or said pillow;

inserting at least one hand under one of said first strap and said second strap; and positioning said front side of said pillow at a distance sufficient to allow a reader to read from said book.

10. The method of claim 6 wherein a closed end of said transparent plastic-type material is coupled to a bottom end of said front side of said pillow and an open end or said transparent plastic-type material is coupled to an upper portion of said front side of said pillow.

11. The method of claim 6 further comprising, in combination, the steps of:

removing said book from between said front side of said pillow and said transparent plastic-type material;

turning a page in said book; and re-inserting said book between said front side of said pillow and said transparent plastic-type material.

* * * * *